US007257917B1

(12) United States Patent
Garland

(10) Patent No.: US 7,257,917 B1
(45) Date of Patent: Aug. 21, 2007

(54) MUZZLE LOADING RIFLE WITH MOVABLE EXTRACTOR

(75) Inventor: Gene L. Garland, New Durham, NH (US)

(73) Assignee: Thompson Center Arms Company Inc., Rochester, NH (US)

( * ) Notice: Subject to any disclaimer, the term of this patent is extended or adjusted under 35 U.S.C. 154(b) by 0 days.

(21) Appl. No.: 11/416,936

(22) Filed: May 2, 2006

(51) Int. Cl.
*F41C 7/00* (2006.01)

(52) U.S. Cl. ..... 42/51; 42/46; 89/1.3

(58) Field of Classification Search ..... 42/51, 42/46; 89/1.3
See application file for complete search history.

(56) References Cited

U.S. PATENT DOCUMENTS 5,737,863 A * 4/1998 Rainey, III ..... 42/51
2002/0035800 A1* 3/2002 Lewis ..... 42/51

* cited by examiner

*Primary Examiner*—Michael J. Carone
*Assistant Examiner*—Gabriel J. Klein
(74) *Attorney, Agent, or Firm*—Langlotz Patent Works, Inc.; Bennet K. Langlotz

(57) ABSTRACT

A muzzle loading firearm has a barrel with a bore defining a bore axis. The barrel has a muzzle end and a breech end, with a breech plug removably attached to the barrel and having a rear surface. An extractor is connected to the barrel and has a portion positioned rearward of the plug, and movable away from a position rearward of the plug, so that the plug may be removed without removing the extractor. The extractor may pivot, and may have a cylindrical portion received in a bore parallel to the barrel bore. The rear face of the extractor may be flush with the rear face of the breech plug.

20 Claims, 4 Drawing Sheets

MUZZLE LOADING RIFLE WITH MOVABLE EXTRACTOR

FIELD OF THE INVENTION

This invention relates to firearms, and more particularly to extractors of muzzle loading firearms.

BACKGROUND AND SUMMARY OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged rear bore portion of the barrel at the breech end. In some rifles, the breech plug is permanently attached. In others, the breech plug is removable to facilitate pass-through cleaning of the bore.

The breech plug has a central rear pocket for receiving a primer, which when struck provides an ignition source that flashes through a passage to the powder contained in the rear of the barrel. To facilitate reloading after a shot, an extractor automatically removes the spent primer upon opening of the rifle's action. The extractor is an L-shaped body with a long leg that reciprocates axially in a passage parallel to and below the barrel bore. A perpendicular short leg extends upward, with a lip at the edge of the primer pocket, so that the primer's rear flange is engaged by the lip. When the action is opened, the extractor slides back, and the lip extracts the primer.

This extractor configuration is convenient to expedite reloading. However, the extractor's position with the short leg behind the center of the breech plug prevents the convenient removal of the breech plug. Plug removal is needed not just for pass-through cleaning of the bore, but for removing a possible wet powder charge that does not fire. In existing rifles, removal of the plug requires that the extractor be removed. This requires removing the rifle stock from the barreled action to expose an extractor-retaining-screw, and then removing that screw to allow the extractor to be removed. This not only is inconvenient, but allows the various parts to be lost or damaged, especially when disassembly is needed in the field, where a bench and suitable tools are not available. The process is repeated in reversed for reinstalling the extractor.

Existing rifles may lack extractors, avoiding the above process, except that these require a tool (or fingernail) to be used for each shot for removing the spent primer.

The present invention overcomes the limitations of the prior art by providing a muzzle loading firearm has a barrel with a bore defining a bore axis. The barrel has a muzzle end and a breech end, with a breech plug removably attached to the barrel and having a rear surface. An extractor is connected to the barrel and has a portion positioned rearward of the plug, and movable away from a position rearward of the plug, so that the plug may be removed without removing the extractor. The extractor may pivot, and may have a cylindrical portion received in a bore parallel to the barrel bore. The rear face of the extractor may be flush with the rear face of the breech plug.

DETAILED DESCRIPTION OF A PREFERRED EMBODIMENT

Figure 1:
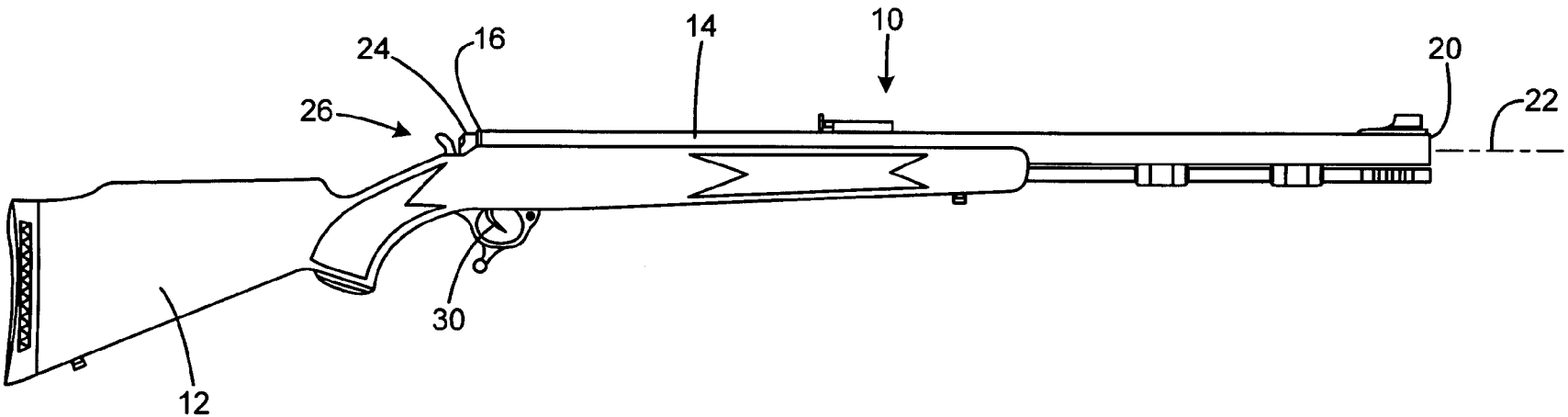
FIG. 1 is a side view of a firearm according to a preferred embodiment of the invention.

FIG. 1 shows a muzzle-loading firearm 10, with a stock 12 and a barrel 14 having a breech end 16 and a muzzle end 20, and having a bore defining a bore axis 22. A movable breech element 24 pivots between an open position and a closed (shown) position. A hammer 26 is pivotally connected adjacent the breech block to operate in response to operation of a trigger 30 as will be discussed below. A muzzle loading firearm having some similar features is disclosed in U.S. Pat. No. 6,604,311 to Laney et al., the disclosure of which is incorporated herein by reference.

Figure 2:
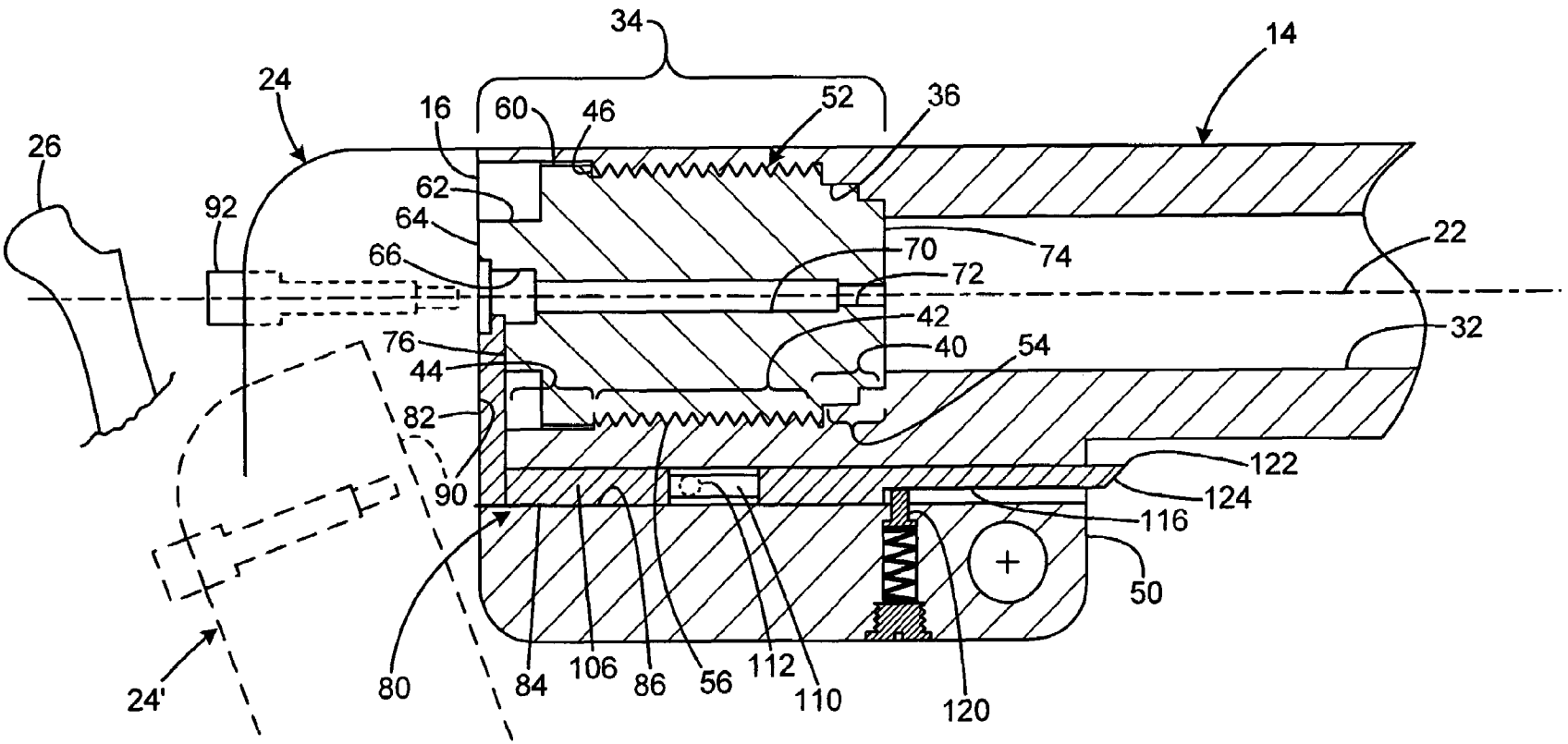
FIG. 2 is a sectional side view of the firearm of FIG. 1, taken along line 3-3 of FIG. 3.

FIG. 2 shows the breech end 16 of the barrel 14. The barrel defines a rifled bore 32 (rifling not shown) that extends from the muzzle nearly the length of the barrel, except for a rear portion 34. The rear portion of the barrel defines an enlarged breech plug chamber 36 having a stepped initial portion 40, an internally threaded intermediate portion 42, and an enlarged clearance portion 44. A shoulder 46 is formed at the rear end of the threaded portion where it meets the larger-diameter clearance portion 44. A lower lug 50 is integrally connected to a rear portion of the barrel.

The rear portion of the barrel is occupied by a breech plug 52. The breech plug is a generally cylindrical body with a nose portion 54 that is stepped to closely fit in the initial portion 40 of the breech plug chamber 36. Most of the length of the plug is provided with helical threads 56, or an alternative fastening element that provides extreme resistance to axial extraction forces, such as provided by firing a shot. The plug has a flange 60 that is larger in diameter than the threaded portion, and which rests against the shoulder 46 when installed, as shown. The rear or breech end portion of the breech plug has a hexagonal profile portion 62, in the shape of a bolt head that may be engaged by a socket wrench for removing and replacing the plug. A flat rear face 64 of the plug's hex portion is flush with the plane defined by the breech end of the barrel.

The breech plug defines a central bore having a primer pocket 66 at the breech end, a flash passage 70 from the primer pocket through most of the length of the plug, and a narrow passage 72 from the flash passage to the nose 74 or forward face of the plug. The primer pocket is generally cylindrical, to fit a standard primer for a muzzle loading rifle, with an enlarged diameter at the rearmost portion to closely accommodate the typical flanged primer.

Figure 3:
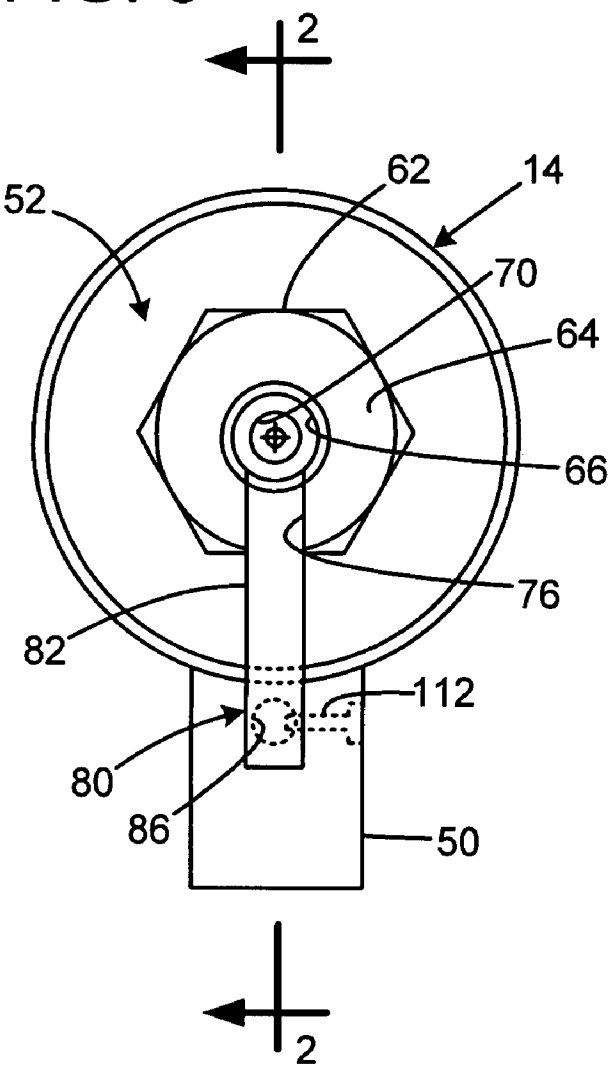
FIG. 3 is a rear view of the firearm of FIG. 1.

As shown in FIG. 3, the breech plug further defines a rectangular slot 76 that extends downwardly, perpendicularly to the bore axis 22, from the center of the primer pocket. The width of the slot is less than the diameter of the flange portion of the primer pocket, and about the same as the diameter of the main portion of the primer pocket. The depth of the slot (along a direction parallel to the barrel axis) is greater than the depth of the flange portion, but less than the depth of the primer pocket overall.

Figure 5:
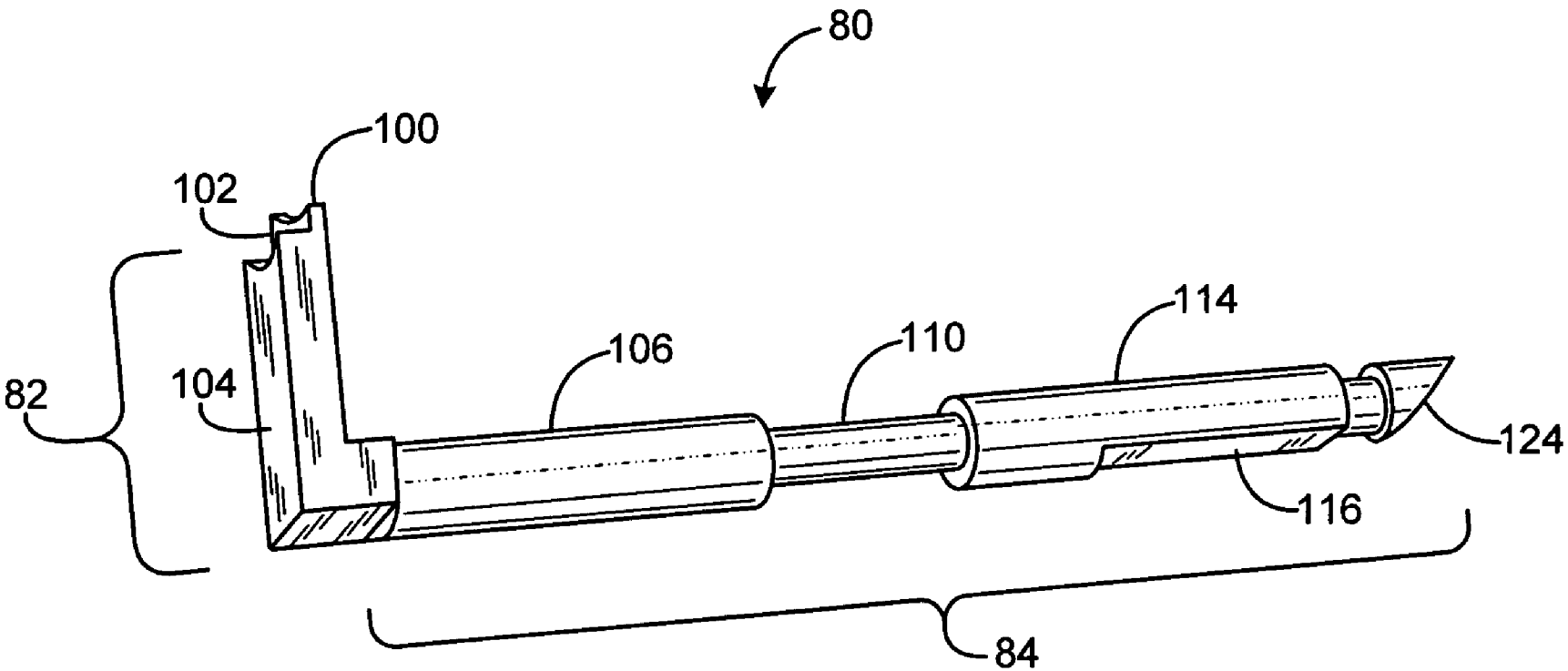
FIG. 5 is a perspective view of a an extractor according to a preferred embodiment of the invention.

As also shown in detail in FIG. 5, an extractor 80 is a solid body with an L-shaped form. It has a short leg 82 with a rectangular cross section that closely fits the slot 76, and a long leg 84 that has a cylindrical form, and which is closely received in a bore 86 in the lower lug. The bore 86 extends axially, parallel to the bore axis 22. The bore is shown as a cylindrically drilled hole, but it may be any opening that restrains a cylindrical form against all movement except axial translation and rotation, such as an open rectangle having cylindrical segments drilled to enlarge it.

A free end 100 of the short leg of the extractor is formed with a curved lip 102 that partly defines the primer pocket, with the same shape as the surface of revolution that defines the pocket. Thus, when the extractor is in the rest position shown, a primer in the pocket is closely received on all sides without substantial gaps, so that it is physically supported against rupture. Together, the rear face 104 of the extractor leg 82 and the hex face 64 entirely encircle the primer pocket.

The short leg 82 of the extractor has a rectangular cross section that closely fits in the slot 76 of the plug's hex portion. The long leg 84 has several different sections. A first cylindrical portion 106 is nearest the short leg, and has a diameter sized to be closely received in the bore 86 for pivoting and axial reciprocation. An adjacent narrow section 110 has a reduced diameter. A stop screw 112 is received in the block 50 and protrudes into the bore at this location to prevent complete removal of the extractor without tools. The reduced diameter portion 110 is narrow enough to allow the extractor to reciprocate and pivot without impediment by the screw 112, which merely limits axial movement of the extractor beyond a limit established by the next full diameter section 114, which has the same diameter as the first section 106. A major forward portion of section 114 has a flat portion 116 that faces downward (in the opposite direction as the short leg 82 extends upward.) This interacts with a spring detent mechanism 120 that biases a spring into the bore 86, so that the extractor resists being moved from the upright position, except by deliberate force against the resistance of the detent. The free end 122 of the long portion 84 of the extractor has a downwardly angled flat latch surface 124 that interacts with the frame to press the extractor rearward when the frame is opened, and a forward portion of the frame presses upward against the latch surface.

The extractor 80 is movable rearward to an extracted position, so that its lip draws a primer in the pocket partially from the pocket, in response to opening of the rifle action, by a linkage (not shown.) The extractor leg 82 inserts in the plug slot only when the plug is in one selected orientation, and prevents plug rotation while in that position. This aids against mis-installation of the plug, and the risk that a plug may work its way out of position during shooting.

The breech element 24 is shown in the closed position in solid lines, and has a breech face 90 that abuts the barrel breech 16 and plug face 64 when closed. This provides a rear surface to fully enclose the primer pocket. A bore in the breech element along the bore axis 22 receives a firing pin 92 that is struck by the hammer 26 to fire the rifle, forcing a tip of the pin into a primer, which sends ignition gases through the plug bore, to ignite gun powder in the barrel. The breech element is shown in the open position (in which the extractor extends to eject the primer) in dashed lines 24'. The extractor is removable to allow removal of the breech plug.

Figure 4:
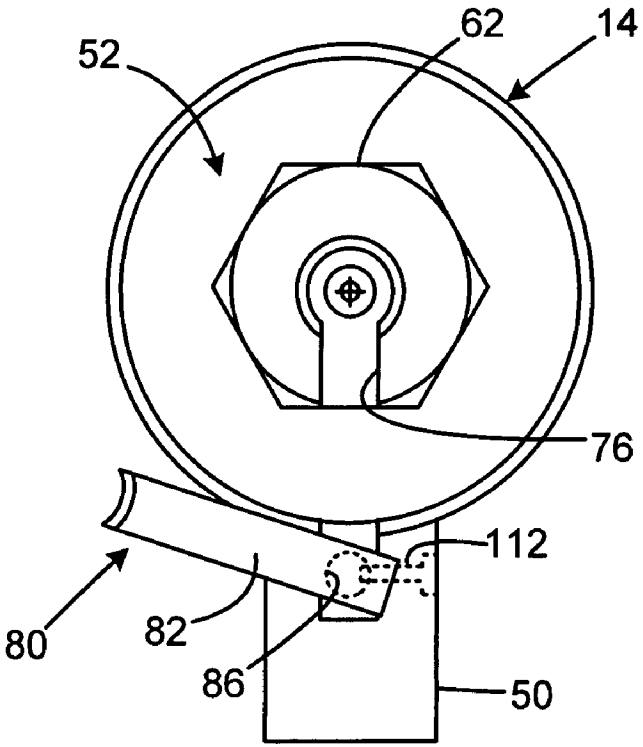
FIG. 4 is a rear view of the firearm of FIG. 1 with the extractor in a pivoted position.

FIG. 4 shows the extractor 80 pivoted laterally to a retracted position that allows removal of the breech plug. In this position, no portion of the extractor is rearward of the breech plug, or occupying the imaginary column that extends rearward from the breech of the barrel. To move to this position, the extractor must be pulled rearward to clear the slot 76 before being tilted.

While the above is discussed in terms of preferred and alternative embodiments, the invention is not intended to be so limited.

The invention claimed is:

1. A muzzle loading firearm comprising:

a barrel with a bore defining a bore axis, and having a muzzle end and a breech end;

a frame connected to the barrel, and having a breech face;

the frame being movable between an open position in which the breech face is away from the breech end of the barrel, and a closed position in which the breech face abuts the breech end of the barrel;

a breech plug removably attached to the barrel and having a rear surface defining a central primer receptacle;

an extractor connected to the barrel and having a primer-engaging portion adjacent to the primer receptacle;

the extractor being operable in response to movement of the frame to the open position to move the primer-engaging portion in a first direction away from the breech plug to extract a primer; and the primer-engaging portion of the extractor being movable in a different second direction such that the breech plug may be removed without removal of the extractor.

2. The firearm of claim 1 wherein the extractor is pivotally connected to the barrel.

3. The firearm of claim 2 wherein the extractor pivots about an extractor axis parallel to the bore axis.

4. The firearm of claim 1 wherein the extractor is an L-shaped body with a first elongated portion defining a pivot axis, and a perpendicular second portion having a free end with a lip for engaging a primer.

5. The firearm of claim 1 wherein the barrel includes an attached block defining a second bore receiving a first potion of the extractor.

6. The firearm of claim 5 wherein at least a portion of the first portion has a cylindrical profile.

7. The firearm of claim 6 including a spring detent element protruding into the bore, and wherein the first portion of the extractor includes a non-cylindrical portion adjacent to the detent element, such that the detent element engages the non-cylindrical portion to retain the extractor in a selected orientation.

8. The firearm of claim 7 where the non-cylindrical portion is a flat surface.

9. The firearm of claim 1 wherein the breech plug defines a slot that closely receives a portion of the extractor, such that neither the breech plug nor the extractor may be rotated when the extractor portion is received in the slot.

10. The firearm of claim 9 wherein extractor portion has a rear face that is flush with the plug rear surface when the extractor portion fully occupies the slot.

11. A muzzle loading firearm comprising:

a barrel with a bore defining a bore axis, and having a muzzle end and a breech end;

a breech plug removably attached to the barrel and having a rear surface;

an extractor connected to the barrel and having an extractor portion rearward of the plug; and the extractor portion being movable laterally with respect to the bore axis away from a position rearward of the plug, such that the plug may be removed without removing the extractor.

12. The firearm of claim 11 wherein the extractor is pivotally connected to the barrel.

13. The firearm of claim 12 wherein the extractor pivots about an extractor axis parallel to the bore axis.

14. The firearm of claim 11 wherein the extractor is an L-shaped body with a first elongated portion defining a pivot axis, and a perpendicular second portion having a free end with a lip for engaging a primer residing in a pocket defined in the rear surface of the plug.

15. The firearm of claim 11 wherein the barrel includes an attached block defining a second bore receiving a first potion of the extractor.

16. The firearm of claim 15 wherein at least a portion of the first portion has a cylindrical profile.

17. The firearm of claim 16 including a spring detent element protruding into the bore, and wherein the first portion of the extractor includes a non-cylindrical portion adjacent to the detent element, such that the detent element engages the non-cylindrical portion to retain the extractor in a selected orientation.

18. The firearm of claim 17 where the non-cylindrical portion is a flat surface.

19. The firearm of clam 11 wherein the breech plug defines a slot that closely receives a portion of the extractor, such that neither the breech plug nor the extractor may be rotated when the extractor portion is received in the slot.

20. The firearm of claim 19 wherein extractor portion has a rear face that is flush with the plug rear surface when the extractor portion fully occupies the slot.

* * * * *